US009899015B2

(12) United States Patent
Sullivan et al.

(10) Patent No.: US 9,899,015 B2
(45) Date of Patent: Feb. 20, 2018

(54) SYSTEMS AND METHODS FOR CREATING DIGITAL NOTE INFORMATION FOR A METAL-STRINGED MUSICAL INSTRUMENT

(71) Applicant: Zivix LLC, Minneapolis, MN (US)

(72) Inventors: Daniel E. Sullivan, Shoreview, MN (US); Robert John Cox, Minneapolis, MN (US)

(73) Assignee: Zivix LLC, Minneapolis, MN (US)

( * ) Notice: Subject to any disclaimer, the term of this patent is extended or adjusted under 35 U.S.C. 154(b) by 0 days.

(21) Appl. No.: 15/429,645

(22) Filed: Feb. 10, 2017

(65) Prior Publication Data

US 2017/0229105 A1 Aug. 10, 2017

Related U.S. Application Data

(60) Provisional application No. 62/293,379, filed on Feb. 10, 2016.

(51) Int. Cl.

| | |
|---|---|
| ***G10H 7/00*** | (2006.01) |
| ***G10H 3/18*** | (2006.01) |
| ***G10H 1/18*** | (2006.01) |

(52) U.S. Cl.
CPC ..... *G10H 3/188* (2013.01); *G10H 1/18* (2013.01); *G10H 3/181* (2013.01)

(58) Field of Classification Search
CPC ..... G10H 3/188; G10H 1/18; G10H 3/181; G10H 1/342
USPC ..... 84/616
See application file for complete search history.

(56) References Cited

U.S. PATENT DOCUMENTS

2013/0180389 A1* 7/2013 Sullivan ..... G10H 1/342 84/723
2014/0290467 A1* 10/2014 Thee ..... G10H 1/0066 84/646

* cited by examiner

*Primary Examiner* — Jeffrey Donels
(74) *Attorney, Agent, or Firm* — Schwegman Lundberg & Woessner, P.A.

(57) ABSTRACT

Systems and methods for a digital instrument are described, for example to simulate or be used in conjunction with a stringed instrument. A sensor system detects the deflection of one or more strings of the digital instrument, produces a measurement of the detected deflection, correlates the measurement to a musical note, and produces at least a portion of digital output based upon the musical note.

20 Claims, 9 Drawing Sheets

SYSTEMS AND METHODS FOR CREATING DIGITAL NOTE INFORMATION FOR A METAL-STRINGED MUSICAL INSTRUMENT

CLAIM OF PRIORITY

This application is a continuation of and claims the benefit of priority under 35 U.S.C. § 119 to U.S. Provisional Patent Application Ser. No. 62/293,379, filed on Feb. 10, 2016, which is hereby incorporated by reference herein in its entirety.

BACKGROUND

The electric guitar and bass are fundamentally analog instruments, and their electrical design has not changed appreciably over the last 50 years. With the advent of low-cost processing and computers, the ability to provide sophisticated musical interfaces has made exponential progress over the same period. The advantages that this technology can bring to the music world is well established in the keyboard world, where pianos have been transformed from a purely mechanical instrument into sophisticated music generators capable of sounding like any other instrument, and the cost has plummeted to where an electronic keyboard is available as an inexpensive consumer product. This same process cannot be said to be true in the electric guitar and bass world.

OVERVIEW OF THE DISCLOSURE

One of the main reasons that stringed instruments, such as the electric guitar or bass, have not entered into the digital world to the extent that pianos have has to with the fact that piano keys can be thought of as switches, and so adapt well to a digital interface. An electric guitar or an electric bass, on the other hand, relies on the vibration of a metal string across an electromagnetic pickup, which produces an analog signal.

Technologies have been developed for "digital" electric guitar and bass that attempt to convert this analog signal into a digital form, which can then be used to interface to digital processors. The standard format in musical electronics for a digital interface is called MIDI, and there are a number of examples of "MIDI" electric guitars and basses currently being sold. These have been in existence for many years, but cannot be said to be a market success, and this is due to some fundamental flaws in the approach currently taken. The principal problem encountered by these examples is that in order to convert from the analog form to a digital one, the frequency of the string must be determined, and this always takes some amount of time. This delay or "latency" is very distracting to a musician attempting to play the electric guitar and bass since the audio feedback is delayed from the time the desired note is struck until the sound is heard. Many advances have been made to reduce the amount of latency, but there is always a perceptible amount. The problem gets worse with lower frequencies, since the period of the frequencies becomes longer and longer, and in the case of bass electric guitar and bass becomes nearly unusable. The fact that the amount of latency varies considerably across the guitar note spectrum is another problem that requires adaptation on the part of the player.

Another problem that is inherent with frequency detection methods is that of capturing expression. An important element of playing guitar is note "bending" or changing the pitch of a note after it is initially played by stretching the guitar string. Since the pitch of the note is constantly changing, the problem of converting this in real time to a digital signal becomes very difficult, and many compromises must be made.

A MIDI note event includes a parameter for velocity. In a keyboard, this represents how fast, or how hard a key was struck. It is typically referred to as the volume of the note. In the digital guitar method using frequency detection, there are additional problems in accurately determining the volume of the note. There is again a finite time that must elapse before this determination can be made, which can cause additional delays on top of the frequency determination. Since both the note and the volume information have to be released together to form a MIDI code, the delay becomes the worst of both.

Both the volume and frequency determination of the note are prone to many errors, which result in false notes in the MIDI codes. There are many overtones in a guitar signal that combine to make these processes difficult; there is ambient noise pickup (typically 60 cycles "hum"), and a variety of other factors that can cause false notes. Clearly, false notes are undesirable for a musician.

One advantage of a digital interface for electric guitar and bass is for educational or game-related feedback where the player can see right away if the right note has been played. With the method used by the present inventors, it is possible for an external program to "see" the finger positions before the string is plucked. This is very important in learning applications or remote learning, where the proper chord position can be read before it is actually strummed. Also, in addition to the delay and other problems just described with regard to the frequency determination method, there is a requirement for these kinds of applications that the guitar is perfectly tuned in order to match the note coming in with the correct one. This tuning is often very difficult for beginners to do, and in an entry-level electric guitar or bass, it can be difficult to maintain proper tuning without frequent adjustment.

The host of problems associated with the current methods is one of the main reasons for the lack of success for MIDI electric guitar and bass. While electronic detection methods have become very sophisticated, there is also a relatively high cost associated with the sophisticated processing power required.

Various techniques have been employed to form a switch matrix. One is to install a series of push-button switches on the fingerboard. This approach does not use guitar strings. These methods require an adaptation of playing style and do not capture expression nuances familiar to guitar players. Another technique that has been used is to take advantage of the fact that the guitar strings are metal, and electrically conductive, as are the fret bars located on the guitar neck. As the strings are fretted by the player, a contact is made and can be read. It is necessary in this case to have special fret bars that are separated into six segments for this method since it is otherwise impossible to distinguish a unique contact when all strings are fretted across (a common bus is formed). This method is expensive to manufacture, and is incapable of capturing expression nuances, as discussed further below.

String "bending"—this is a common technique in which a string is stretched while pushing down on the fret. This has the effect of increasing the pitch of the string up and down as the string is moved perpendicular to the fretboard.

Vibrato—After a string is picked, if the fingertip that is on the fretboard is moved up and down in line with the fretboard, there will be a small change in the frequency of the note. This is typically done in a rapid manner, and in concept is similar to the same technique commonly associated with violin playing.

Hammer-ons—This is a technique in which a player uses a finger to play an additional note without re-picking the string. The loudness of the new note is proportional to how hard the note is "hammered" by the player Pull-offs—This is the reverse operation of a hammer-on. A new note is played by removing a finger from a fret position—causing the note to sound.

In some examples, construction of a fully-digital guitar that eliminates the problems just described, in a cost-effective manner, without requiring any adaptation on the part of the musician, and capable of capturing the nuances of musical expression that is necessary to make a digital guitar the equivalent of a normal guitar. Application of the discussed technologies can be applied to existing stringed instruments with minimal alteration, while allowing the instrument to maintain its non-digital characteristics.

In some embodiments, the systems and methods described herein are implemented in a guitar, and more specifically an electric guitar. In other embodiments, the systems and methods described herein are implemented in other musical instruments with metal strings.

BRIEF DESCRIPTION OF THE FIGURES

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
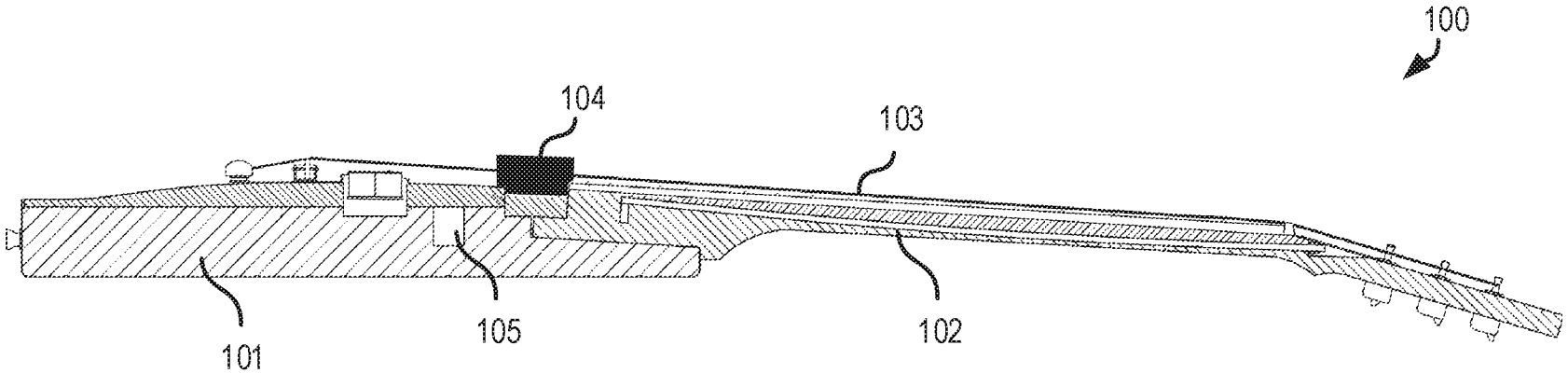
FIG. 1 illustrates a musical instrument according to one embodiment.

In the following detailed description, reference is made to the accompanying drawings which form a part hereof, and in which is shown, by way of illustration, specific embodiments in which the invention may be practiced. In the drawings, which are not necessarily drawn to scale, like numerals describe substantially similar components throughout the several views. The drawings illustrate generally, by way of example, but not by way of limitation, various embodiments discussed in the present document. These embodiments are described in sufficient detail to enable those skilled in the art to practice the invention. Other embodiments may be utilized and structural, logical, electrical changes, etc. may be made without departing from the scope of the present invention.

Various systems and methods for a digital guitar are described herein. The digital guitar may appear and play nearly identically to a standard guitar. However, the digital guitar may provide a digital output rather than a standard analog output provided by an electric guitar or by an acoustic guitar using an embedded pickup in the sound box.

Unlike previous attempts at creating a digital guitar, certain embodiments allow for the generation of a digital signal representative of the notes being played without noticeable latency that results from frequency analysis of the standard analog output signal. The digital guitar described herein may allow for the determination of where each string is being fretted based on detecting the locations of the musician's fingers. The digital guitar may also determine what expression nuances are modifying notes being played. According to some aspects of the disclosure, the digital guitar may detect which strings are being played and a volume associated with each string. The digital guitar may combine information about which strings are being played with information about which strings are being fretted to generate a digital output.

In certain embodiments, a digital interface for guitars may be used with, for example, educational or game-related software or systems. With certain systems and methods described herein, it is possible for an external program to determine the finger positions prior to actually plucking the string and for the player to see right away if the correct note has been played. This may be advantageous in learning applications or remote learning, where the proper chord position can be read before it is actually strummed.

In some embodiments, a digital guitar allows for the relatively inexpensive construction of an instrument that may be played in a similar manner to an existing instrument, while allowing nearly infinite variations. More advantages and novel aspects will be described below with reference to the drawings.

FIG. 1 shows a musical instrument 100. The instrument 100 is an electric guitar in the embodiment shown, but aspects of the disclosure are applicable to other instruments as well. For example, the instrument 100 could alternatively comprise an acoustic guitar, a cello, a violin, or some other musical instrument.

The example instrument 100 comprises a body portion 101, a neck portion 102, metal strings 103, an optical pickup array 104, and inductive coil to digital system. One end of the neck 102 is connected to the body portion 101 and an opposite end of the neck 102 has a headstock portion 107.

In FIG. 1, the fret area of the neck 102 of an electric guitar or bass consists of metal fret bars, across which some number of metal strings 103 pass over at a near 90-degree angle. In conventional analog instruments, the player presses a finger down behind the metal fret, which shortens the effective length of the string, thus increasing its frequency when the string is then plucked. As shown in FIG. 1, the neck of the instrument has a slight forward angle to it to avoid "fret buzz". Fret buzz occurs when this forward angle is insufficient for the string to clear subsequent frets once a fret position has been selected. The strings rotate around when picked, and it can be seen that there is a certain amount of clearance needed above each fret so that the string will not contact undesirable fret positions. So, by definition, electric guitars and basses have strings that proceed down the fret area at a slight angle.

Figure 2A:
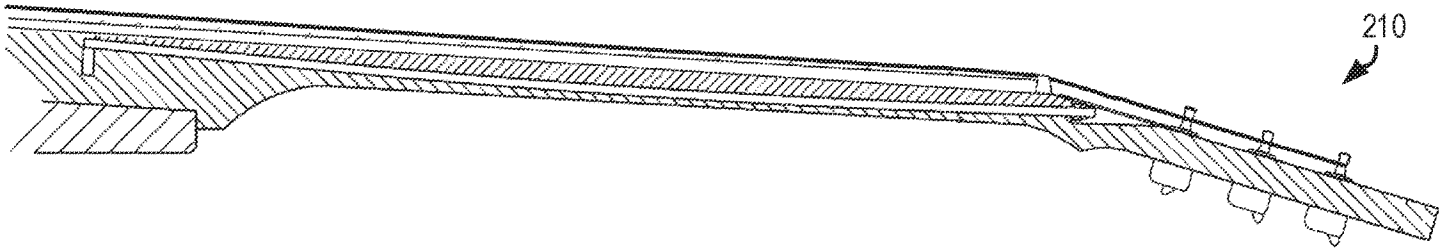
FIGS. 2A and 2B illustrate a fret board and strings of a musical instrument according to one embodiment.
Figure 2B:
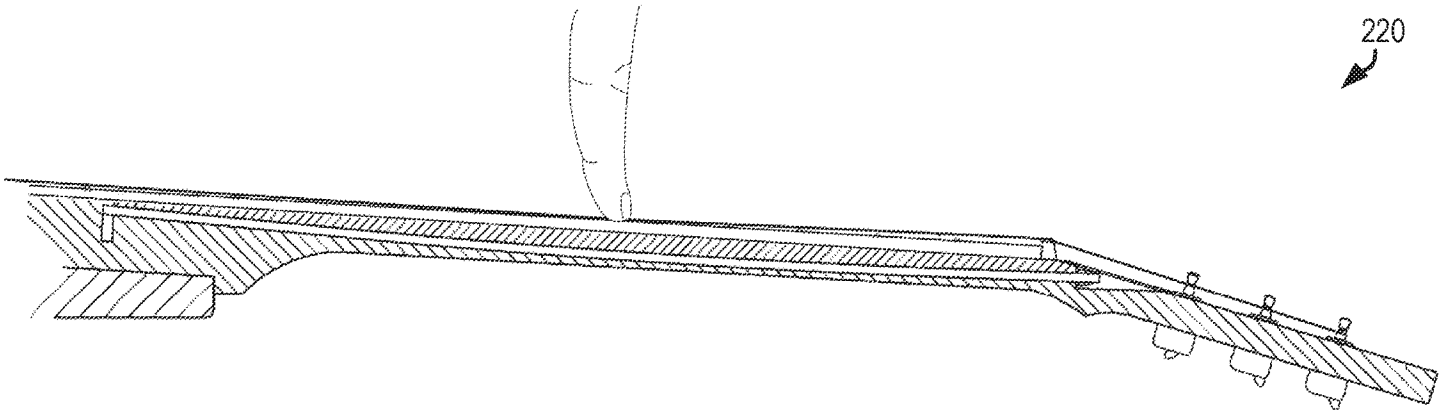

FIGS. 2A and 2B shows the neck of a guitar including the fretboard and strings 210 and 220, FIG. 2A without the strings pressed down and FIG. 2B showing at least one string being pressed down by a finger. The string has a small amount of downward movement along its length when a string is pressed down behind a fret. The amount of this movement depends on which fret position is being pressed down. This downward movement increases progressively as the finger is moved down the neck area from one position to the next.

Figure 3:
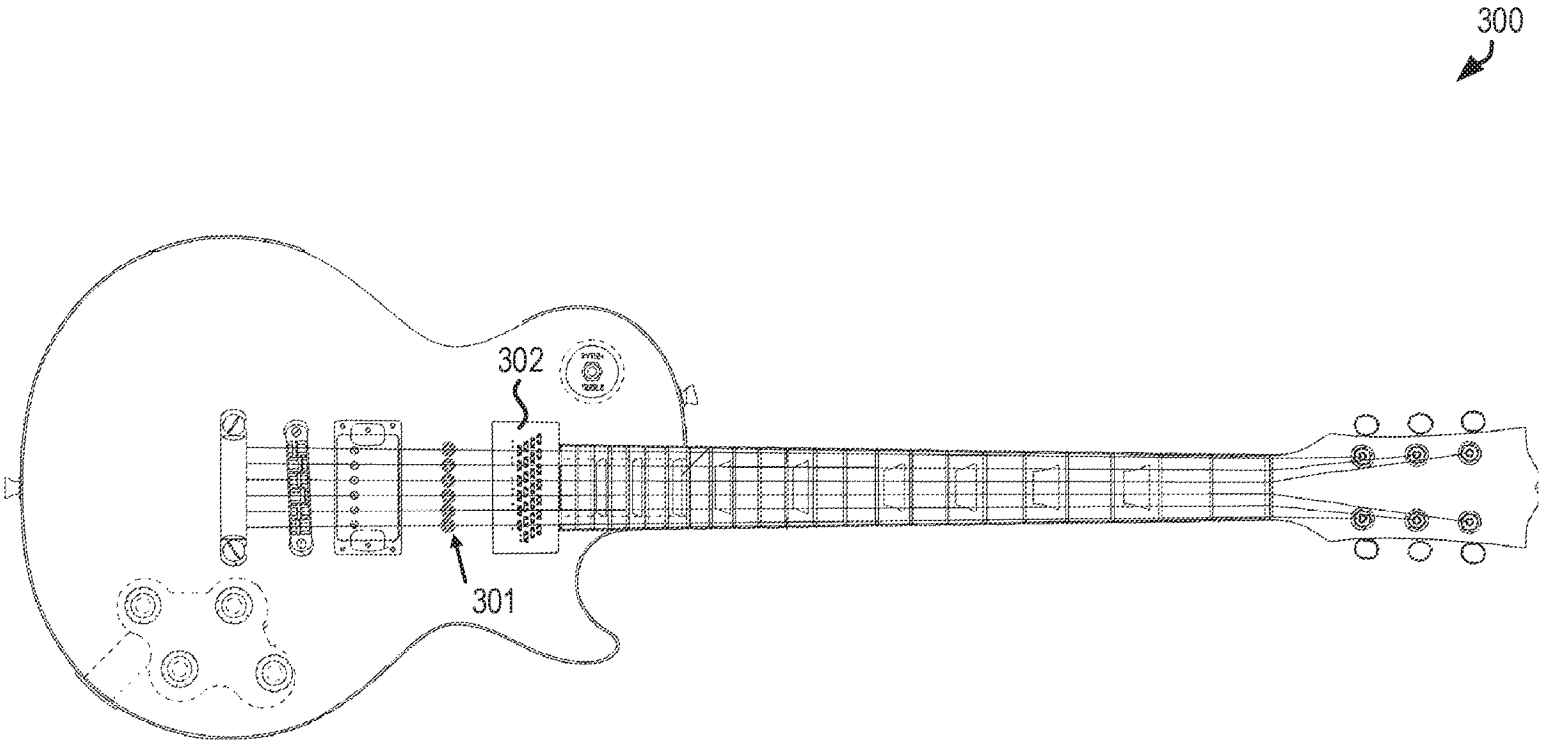
FIG. 3 illustrates a musical instrument according to one embodiment.

FIG. 3 shows a guitar 300 and that each metal string of the instrument passes over an inductive coil (the resonant coils 301 in the Figure) and an optical array 302. A conventional guitar pickup also consists of an inductive coil, but in a conventional pickup, a voltage is generated by the string moving across the magnetic field, as in the action of an electrical generator. A conventional guitar pickup is unsuited for picking up small vertical movements. In contrast, the inductive method used consists of a tuned circuit.

Figure 4:
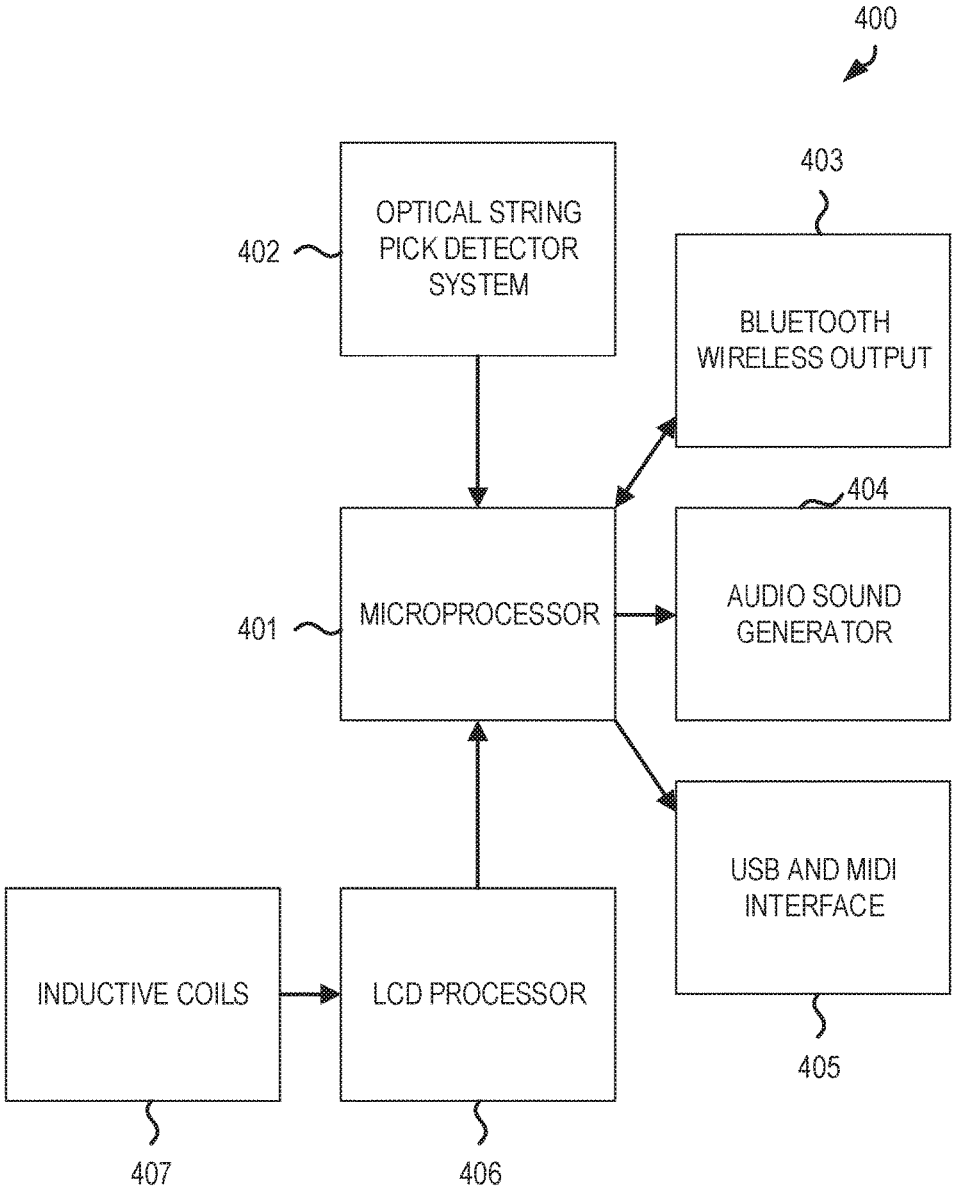
FIG. 4 illustrates a block diagram according to one embodiment.

FIG. 4 shows a block diagram of an example system 400. The example system comprises a microprocessor 401, an optical string pick detector system 402 (also discussed and illustrated as optical pickup array 104), a Bluetooth wireless output device 403, an audio sound generator 404, a USB and MIDI interface 405, a inductance-to-digital converter (LDC) Processor 406, and inductive coils 407 (also discussed and illustrated as coils 301). FIG. 3 depicts an example location for the inductive coils 407 at 301.

In some examples, there is an inductive coil for each string of the musical instrument. In some examples, there are multiple inductive coils for each string of the musical instrument.

Figures 5A, 5B, 5C:
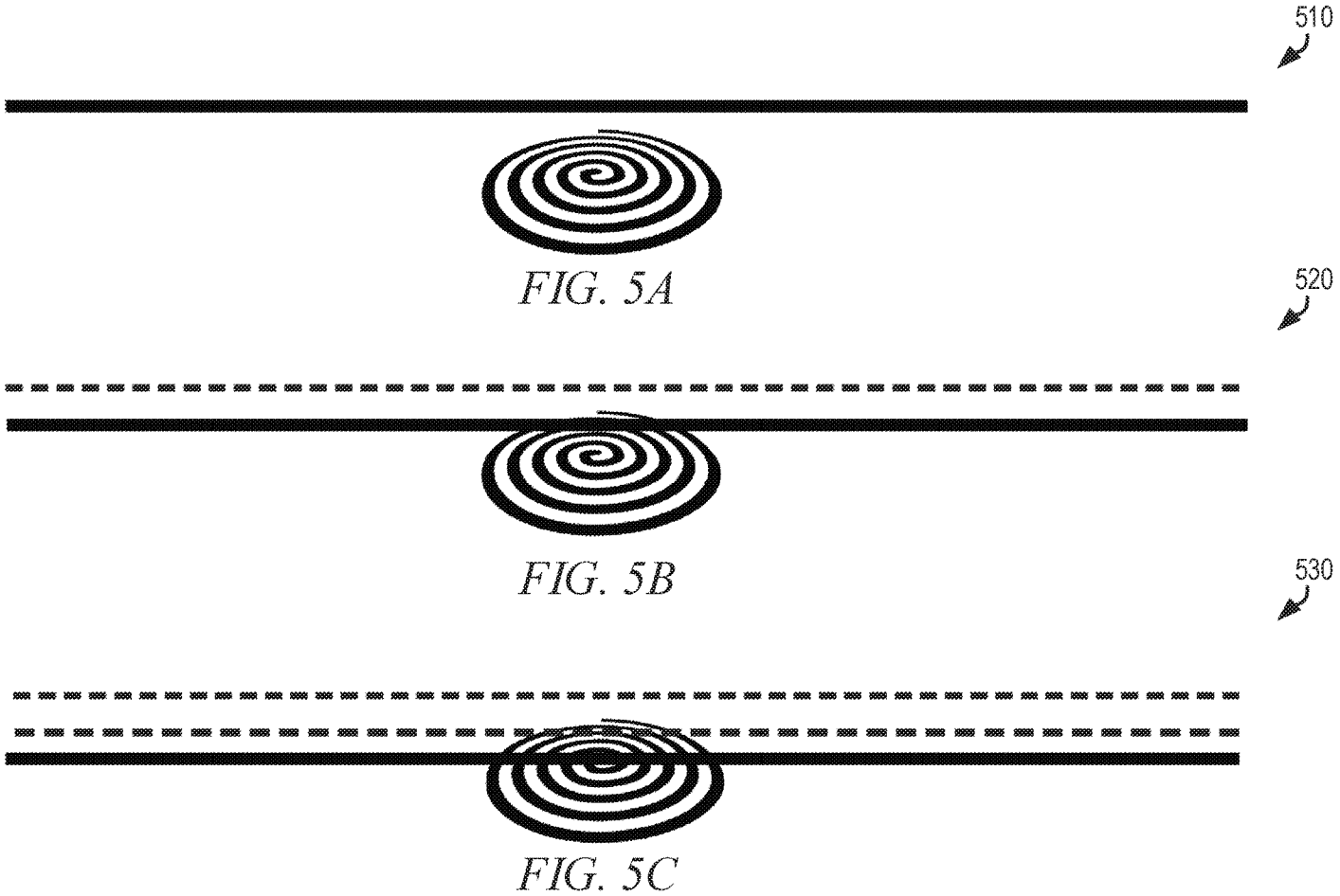
FIGS. 5A, 5B, and 5C illustrate a metal string and inductive sensor according to one embodiment.

FIG. 5A-5C shows the deflection of a string based on different fingering positions on a fretboard. In an example, FIG. 5A shows a default position of a string with no corresponding fingering position 510. In an example, FIG. 5B shows a first string deflection at a first fingering position 520. In an example, FIG. 5C shows a second string deflection at a second fingering position 530.

Figure 6:
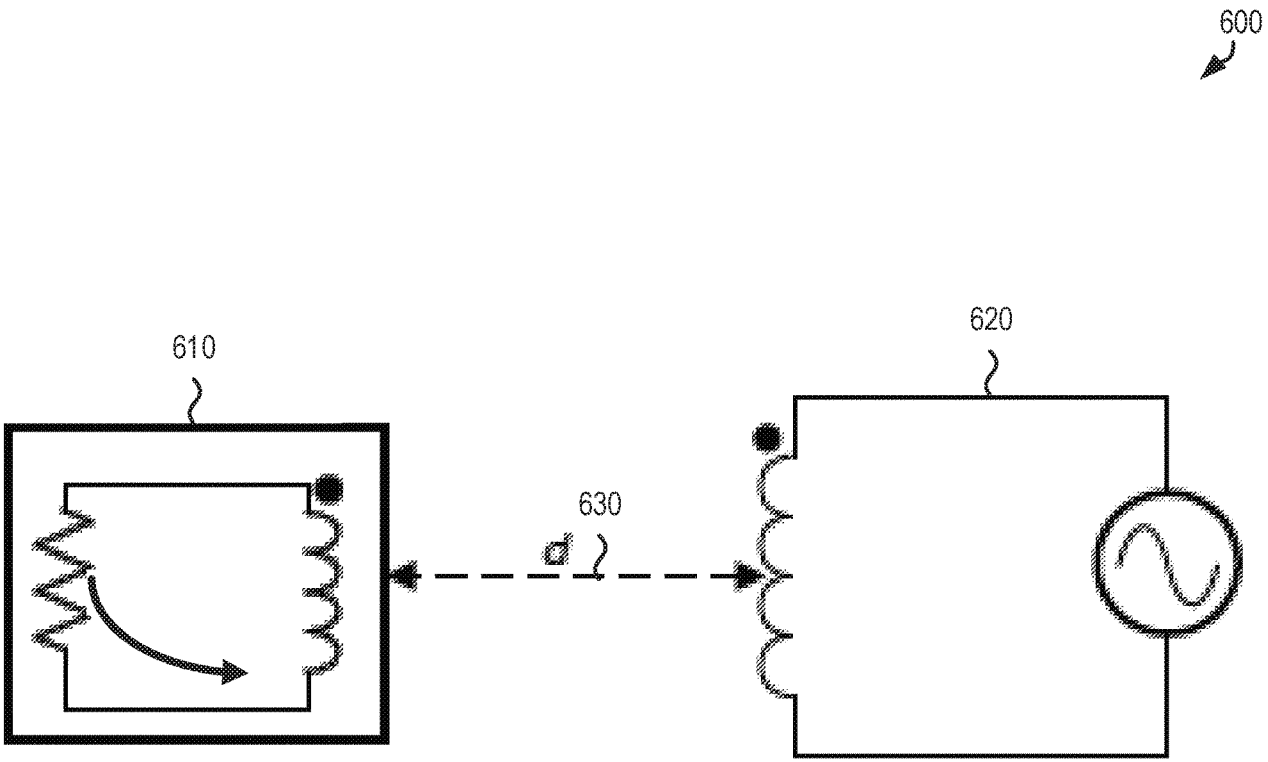
FIG. 6 illustrates an example inductive circuit schematic.

FIG. 6 shows an example inductive circuit 600 comprising a conductive target 610, an inductive pickup 620, and a distance 630 between the two. The conductive target 610 includes an eddy current passing through a resistance and an inductor. The inductive pickup 620 includes an inductor and provides an AC signal source corresponding to the eddy current of the conductive target.

Figure 7:
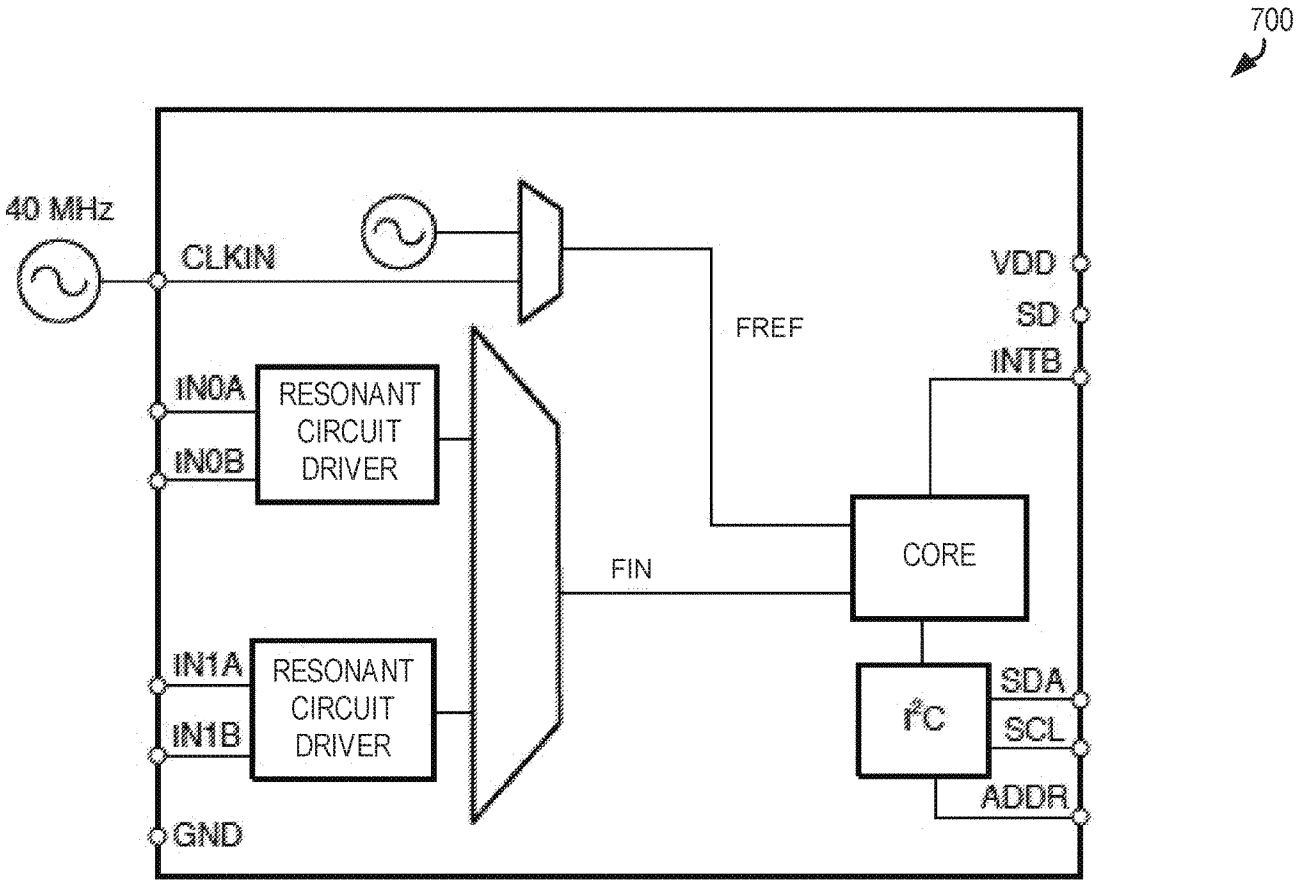
FIG. 7 illustrates a block diagram of a circuit according to one embodiment.

FIG. 7 shows an example circuit block diagram 700 for an LDC. In an example the input AC signal can be the AC signal source from FIG. 6. The LDC includes resonant circuit drivers, multiplexors, an internal oscillator, and an I2C interface for converting an analogue signal to a digital representation of the analogue signal frequency.

Figure 8:
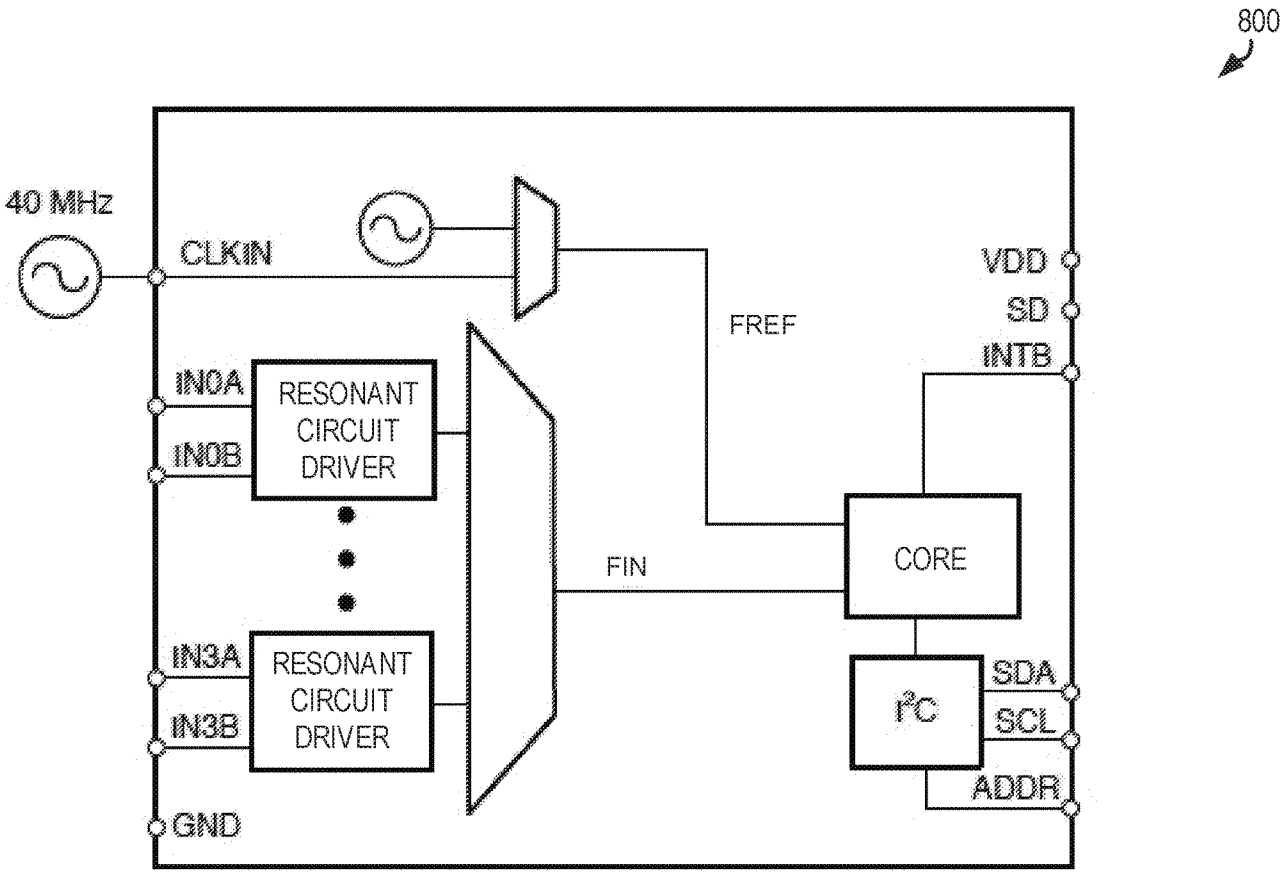
FIG. 8 illustrates a block diagram of a circuit according to one embodiment.

FIG. 8 shows an example circuit block diagram 800 for an LDC. In an example the input AC signal can be the AC signal source from FIG. 6. The LDC includes resonant circuit drivers, multiplexors, an internal oscillator, and an I2C interface for converting an analogue signal to a digital representation of the analogue signal frequency.

Figure 9:
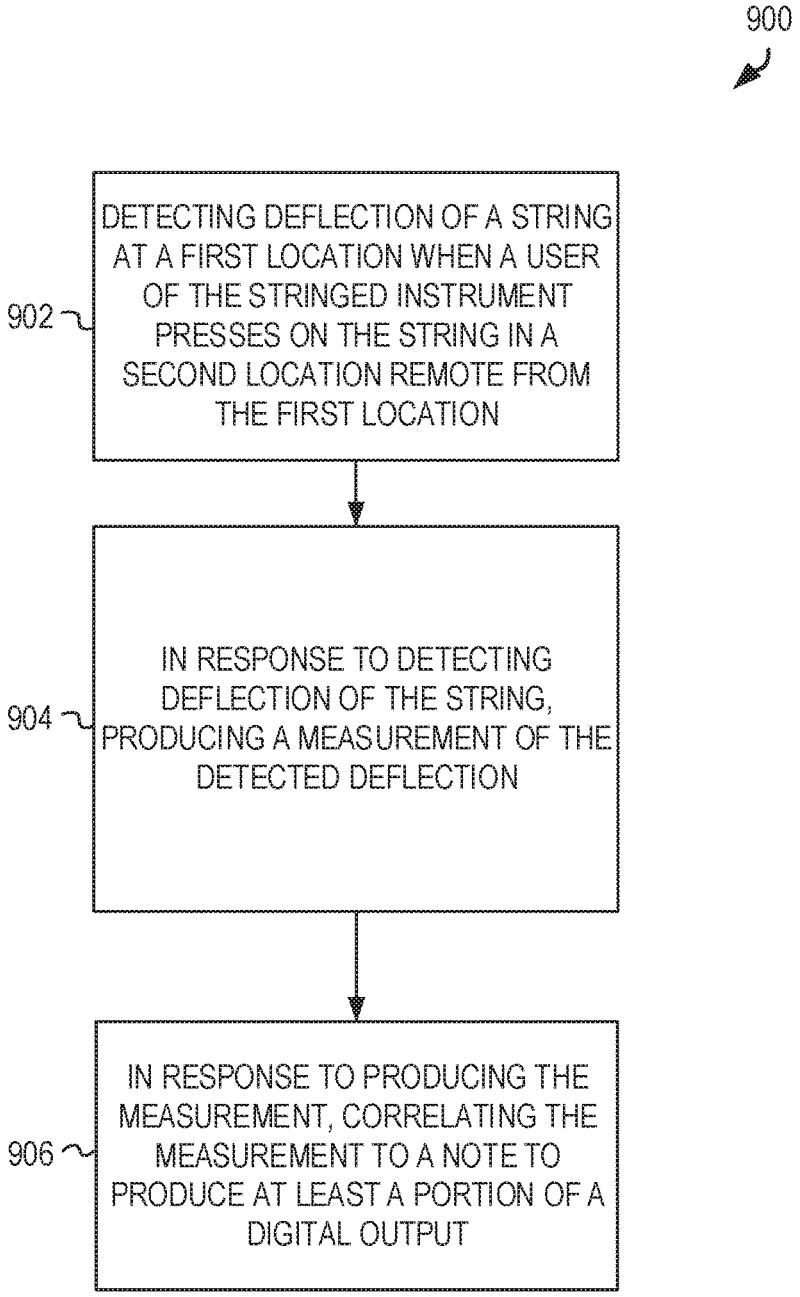
FIG. 9 illustrates a method for creating digital note information to one embodiment.

FIG. 9 shows an example method for creating digital note information 900. As shown, detecting deflection of a string at a first location when a user of the stringed instrument presses on the string in a second location remote from the first location occurs at operation 902. In response to detecting deflection of the string, producing a measurement of the detected deflection occurs at operation 904. In response to producing the measurement, correlating the measurement to a note to produce at least a portion of a digital output at operation 906.

Inductive Sensing of String Position

The fret area of an electric guitar or bass consists of metal fret bars, across which some number of metal strings pass over at a near 90-degree angle. In conventional analog instruments, the player presses a finger down behind the metal fret, which shortens the effective length of the string, thus increasing its frequency when the string is then plucked. As shown in FIG. 1, the neck of the instrument has a slight forward angle to it to avoid "fret buzz". Fret buzz occurs when this forward angle is insufficient for the string to clear subsequent frets once a fret position has been selected. The strings rotate around when picked, and it can be seen that there is a certain amount of clearance needed above each fret so that the string will not contact undesirable fret positions. So, by definition, electric guitars and basses have strings that proceed down the fret area at a slight angle.

Because of this angle, the string has a small amount of downward movement along its length when a string is pressed down behind a fret. The amount of this movement depends on which fret position is being pressed down. This downward movement increases progressively as the finger is moved down the neck area from one position to the next (FIG. 2).

In some examples, if the amount of this movement could be accurately measured, it can be seen that it is possible to calculate what fret position has been pressed. This method would then serve to provide a no-latency method of determining what the intended pitch will be once the string is plucked. Since the position is known prior to plucking the string, the digital note code can be produced immediately upon release of the string, thus eliminating the sources of latency in prior methods. The difficulty involves devising a method to measure sub-millimeter movements of the metal string accurately. A mechanism capable of such sub-millimeter measurements is called an inductance-to-digital converter, or LDC. An LDC is essentially an inductive coil that is capable of detecting changes in distance of a metallic object located near the LDC. In an example, one such device is a multi-channel 28-bit inductance to digital converter for inductive sensing from Texas Instruments, such as LDC 1612 or LDC1614. In other examples, other LDC circuits can be used.

In an example, the amount of resolution in these devices is sufficient to measure the slight movement of a metal string when pressed down on in the fret area of a guitar or bass instrument that has metal strings. This is shown in FIG. 5. The prototype uses one inductive coil under each string. More or less coils might also be used depending upon resolution and measurement range. Thus, the problem of predetermining the fretted position that has been pressed down by a player can be solved in a novel way that does not require the custom manufacture of the neck of a fretted instrument.

As illustrated in FIGS. 5A-5C, different figuring positions produce a different downward deflection of the string. For example, FIG. 5A illustrates a default position of a particular string (no deflection from a user figuring a note on the fret board). Next, FIG. 5B illustrates a first deflection associated with a first figuring position along the fret board. Finally, FIG. 5C illustrates a second deflection associated with a second figuring position along the fret hoard. LDCs positioned properly under each string allows for measurement of the different deflection distances, which can then be correlated to different notes (or at least figuring positions along the fretboard).

Calibration Method

Because there can be a wide variation in the angle of the strings from one guitar or bass to another, it is desirable to have a calibration method so that a retrofit can be done on existing instruments. in an example, a calibration method can be used to account for these differences.

In an example, one method that can be used with the an inductive sensing method is that during initial setup, a player can fret specific positions, and the system will then "learn" and store the appropriate values in internal memory. String deflections associated with each learning position will be stored and associated with various notes or cords (multiple strings) to adjust for individual instrument variations.

Correlation With String Plucking

Guitars and basses produce notes through a combination of a fret selection with one hand, and a string pluck with the other. In an example, a digital system uses the correlation of these two actions. In the MIDI digital music standard, the velocity (volume) of the note needs to be transmitted at the same time as the pitch information. This can be a source of latency in a digital system because the amplitude of the vibrating string is not available immediately, but instead takes some time to analyze using typical technologies. Since a digital system does not require the string to produce a sound or be tuned, it can be advantageous to determine the volume of the string while also muting the string. Accordingly a system has been designed that measures the displacement of the string prior to the plucking of it. In an example, this system involves an optical pickup array, such as optical pickup array 104, detecting and measuring string defection. The volume of the note will be proportional to the amount of stretching that is done prior to its release. in the system described, an optical method is employed to achieve the goal of volume and pluck detection. The optical pickup array 104, can include a series of LEDs is positioned over the strings in such a way that the shadow of the strings falls on an array of photoreceptors. The optical pickup array 302 of FIG. 3 shows that the LEDs are mounted under a shield that protects stray light from affecting the photoreceptors, and preferably use infrared transmission to avoid ambient lighting issues. When the string is stretched in either direction during a pick event, the shadow of the string will move across the surfaces of the photodetector array that is shown in FIG. 3. In some examples, the LEDs are mounted adjacent to the photoreceptors, and instead of sensing a shadow the photoreceptors are sensing the peak reflected light from the strings.

In some examples, the analog signal that is produced can be read through an A/D converter in a microprocessor. Software that runs on this microprocessor can then execute an algorithm that can determine when the shadow (or peak reflection) of the string has reversed direction. At that point, the distance that the string has traversed from its rest position is used to generate a velocity code along with the pitch code.

As previously described, the pitch detection system can use an up and down movement of the string to detect a pitch selection on the fretboard. However, a signal will be output from the magnetic coils when a string is moved from side to side, as happens during string picking. In an example, software can be used to separate the pitch selection event from the picking event, as they often occur at different times, but there are activities such as "string bend" that create some challenges for the analysis software. If a pick is not perfectly perpendicular to the fret board the pick can also create slight upward and downward movements of the string, obscuring the information about string height used to determine the fretted position.

In an example, output from both the pick sensors and the pitch sensor can be examined and the analysis software can more readily distinguish the picking and fretting events. The pick sensor array can also see the shadow (or reflection) of the string being enlarged as the string is pressed down. This assists in the matter of detecting string bending after a note is plucked, thus providing an important expression parameter that would be difficult to detect using either system alone.

Description of an Example Complete System

As shown in the example of FIG. 3, each metal string of the instrument passes over an inductive coil (the resonant coils in the Figure), coils 301. A conventional guitar pickup also consists of an inductive coil, but in a conventional pickup, a voltage is generated by the string moving across the magnetic field, as in the action of an electrical generator. A conventional guitar pickup is unsuited for picking up small vertical movements. In contrast, the inductive method used consists of a tuned circuit, such as the circuits illustrated in FIGS. 7-9.

A block diagram of an example system is shown in FIG. 4, The effects of the very small up and down movement of conductive material (guitar string) are processed by a dedicated integrated circuit and digital information regarding its position is output to a microprocessor. The software running on this microprocessor analyzes the data coming from the inductive sensors and correlates this with the string plucking information. When the string is released, a calculated MIDI note code that includes volume and pitch information is output via a MIDI or USB port. Wireless operation is possible through the use of a Bluetooth transmitter. The microprocessor also manages this transmitter and can cause it to output BLE MIDI in a format that has now been standardized so that the instrument can be directly used with software programs used to edit and produce music.

An example internal method of generating sound can be included in the system. In this case, the digital information can be used to create notes with a wide variety of sounds. An external system is not required to create the sounds when this is included. The advantage of the internal system is that the very low latency aspect of the system can be used to capture a wider range and type of expression information. The combination of the pitch, pick, and sound generating system enables the capture of accurate expression information. In addition, it provides the ability to capture new forms of musical expression that are not at all possible with higher-latency digital music systems.

In an example, the parameters of the sound system can be controlled via the wireless interface using software running on external devices. Firmware updates to change or add features may also be done through this interface.

What is claimed is:

1. A method for capturing notes played on a stringed instrument, the method comprising:

detecting deflection of a string at a first location when a user of the stringed instrument presses on the string in a second location remote from the first location;

in response to detecting deflection of the string, producing a measurement of the detected deflection; and in response to producing the measurement, correlating the measurement to a note to produce at least a portion of a digital output.

2. A system for capturing notes played on a stringed instrument, the system comprising:

at least one inductive coil positioned under at least one string at a first longitudinal position along the length of the at least one string;

a digital circuit communicatively coupled to the plurality of inductive coils to receive signals indicating displacement of the at least one string and to produce measurements of the displacement; and a microprocessor communicatively coupled to the digital circuit and configured to receive the measurements and correlate them to musical notes.

3. The method of claim 1, wherein the detecting deflection includes receiving a signal indicative of the string deflection at the first location from an inductive coil.

4. The method of claim 1, wherein the detecting deflection includes detecting deflection at the first location, wherein the first location is on the body of a stringed instrument.

5. The method of claim 4, wherein the detecting deflection includes detecting deflection caused by the user pressing on the string in the second location, wherein the section location is on a neck portion of the stringed instrument.

6. The method of claim 5, wherein the second location is associated with a fret on the neck portion of the stringed instrument.

7. The method of claim 1, further comprising detecting a pluck of the string on the stringed instrument.

8. The method of claim 7, further comprising outputting the digital output corresponding to the note and the pluck of the string.

9. The method of claim 8, wherein the detection of the pluck of the string provides volume corresponding to an amplitude of the pluck.

10. The system of claim 2, further comprising an optical pickup array positioned to detect movement of the string on the stringed instrument.

11. The system of claim 10, wherein the microprocessor is communicatively coupled to the optical pickup array and configured to detect string pluck using data received from the optical pickup array.

12. A method for capturing notes played on a stringed instrument with a neck and body, the method comprising:

measuring deflection of a string at a first location on the body when a user of the stringed instrument presses on the string in a second location on the neck;

in response to measuring deflection of the string, correlating measured deflection distance of the string to a musical note or expression to produce a first portion of a musical digital output;

detecting a pluck of the string; and in response to detecting the pluck, producing a second portion of the musical digital output.

13. The method of claim 12, further comprising outputting the musical digital output corresponding to a combination of the first portion of the musical digital output and the second portion of the musical digital output.

14. The method of claim 13, wherein the first portion of the musical digital output corresponds to a note.

15. The method of claim 13, wherein the second portion of the musical digital output corresponds to a volume.

16. The method of claim 12, wherein measuring deflection of the string includes measuring a movement of the string towards the body of the stringed instrument caused by a user pressing the string against a fret on the neck at the second location.

17. The method of claim 12, wherein the measuring deflection includes receiving a signal indicative of string deflection at the first location from an inductive coil.

18. The method of claim 12, wherein the detecting the pluck of the string provides volume corresponding to an amplitude of the pluck.

19. The method of claim 12, wherein detecting the pluck includes receiving a signal from an optical pickup array positioned to detect movement of the string on the stringed instrument.

20. The method of claim 12, wherein the first portion of the musical digital output is a pitch code and the second portion of the musical digital output is a volume code.

* * * * *